US005511132A

United States Patent [19]

Yoshimi

[11] Patent Number: 5,511,132

[45] Date of Patent: Apr. 23, 1996

[54] COMMUNICATION DEVICE HAVING AIR-BORNE AND SOLID-BORNE TRANSMITTING AND RECEIVING DEVICES

[75] Inventor: Toshikazu Yoshimi, Saitama, Japan

[73] Assignee: Pioneer Electronic Corporation, Tokyo, Japan

[21] Appl. No.: 318,518

[22] Filed: Oct. 5, 1994

Related U.S. Application Data

[63] Continuation of Ser. No. 94,987, Jul. 22, 1993, abandoned.

[30] Foreign Application Priority Data

Aug. 31, 1992 [JP] Japan ..... 4-066746 U

[51] Int. Cl.[6] ..... H04R 25/00

[52] U.S. Cl. ..... 381/205; 381/68.3; 381/151; 381/169; 381/91

[58] Field of Search ..... 381/205, 151, 381/68.3, 169, 91, 188, 25, 183; 379/430; 455/89, 90

[56] References Cited

U.S. PATENT DOCUMENTS

| | | | |
|---|---|---|---|
| 3,629,521 | 12/1971 | Puharich | 381/151 |
| 3,916,312 | 10/1975 | Campbell | 325/16 |
| 5,125,032 | 6/1992 | Meister et al. | 381/183 |

*Primary Examiner*—Curtis Kuntz
*Assistant Examiner*—Sinh Tran
*Attorney, Agent, or Firm*—Nikaido, Marmelstein, Murray & Oram

[57] ABSTRACT

An air-borne converting device and a solid-borne converting device is provided in a case. The air-borne converting device has a loudspeaker for converting an electric signal into an air-borne sound, and a microphone for converting air-borne sound into an electric signal. The solid-borne device has a loudspeaker for converting an electric signal into solid-borne sound and a microphone for converting solid-borne sound into an electric signal.

2 Claims, 3 Drawing Sheets

COMMUNICATION DEVICE HAVING AIR-BORNE AND SOLID-BORNE TRANSMITTING AND RECEIVING DEVICES

This application is a continuation application Ser. No. 08/094,987 filed Jul. 22, 1993, abandoned.

BACKGROUND OF THE INVENTION

The present invention relates to a communication device, and more particularly to a transceiver adapted to be used in an extremely noisy surroundings such as a motor race course and a construction site.

A transceiver, which is a widely-used portable transmitter, is usually used under circumstances where there is little noise. With such a transceiver, transmission between two people can be satisfactorily made without any difficulty in an environment where ambient noise is lower than 90 dB. However, if the ambient noise exceeds 90 db, the noises are picked up by the microphone, and due to the masking effect, it becomes impossible for the recipient to clearly discern the transmitted speech.

In order to solve the problem, the inventor of the present invention has proposed in Japanese Patent Laid Open 5-22784, a solid-borne sound transmitting device.

Referring to FIG. 3, the transmitting device comprises a headset 1 having an arm 2, and a vibration pickup 3 disposed on an inner end portion of the arm 2.

The headset 1 is worn over a head 4 of an operator, so that the vibration pickup 3 is pressed on a cheek 5. When the operator speaks, solid-borne vibrations generated in the cheek 5 is efficiently converted into an electrical signal by the vibration pickup 3 and transmitted to a receiving device of the recipient.

The reason the pickup 3 is abutted on the cheek 5 and not on other parts of the head is that the cheek generates vibrations, the level of which is higher than those from other parts, and that the frequency of the vibration falls within a spectrum space wherein words of the speaker is sufficiently articulated. In addition, cheeks are less sensitive to pain and other discomforts even after a long-term use.

The inventor of the present invention has also proposed in Japanese Patent Application No. 3-131436 an earphone shown in FIGS. 4 and 5, which blocks ambient noises.

Referring to FIG. 4, the earphone has a dynamic exciter 9 housed in a plastic casing 11 having an upper opening. A cylindrical yoke 14 is resiliently mounted with appropriate stiffness in the casing 11 by a plurality of dampers 13. A magnet 15 is axially provided in a central portion of the yoke 14, and a central pole 16 is mounted on the magnet 15. A metalic diaphragm 12 is mounted on the top of the casing 11 to hermetically close the casing 11. A voice coil 17 is attached on the underside of the diaphragm 12 so that, when the diaphragm 12 is mounted, the voice coil 17 is disposed in an annular space between the yoke 14 and the central pole 16 without touching them.

Referring to FIG. 5, when using the earphone, an earplug 8 is inserted in an external auditory canal 7 of an ear. The earplug 8 is made of a sound insulating material such as a closed-cell polymer foam, for example, urethane foam.

In order to hear the transmission, the dynamic exciter 9 is held to contact the earplug 8. When the voice coil 17 of the exciter 9 is applied with an audio signal ViN through a lead 18, an alternating field is generated by the voice coil 17, and a magnetic field is caused by the magnetic circuit comprising the magnet 15 and the center pole 16. Hence the voice coil 17 is moved in the magnetic field as a result of electromagnetic induction in accordance with the frequency of the input audio signal $V_{IN}$. The voice coil 17 accordingly elastically vibrates the metal diaphragm 12, thereby forming elastic waves. Namely, the exciter 9 is different from a regular sound radiating speaker in that it is a shaker which causes elastic vibration of the diaphragm 12. The ear plug 8, an end of which is in contact with the diaphragm 12, serves as a couplant for propagating the elastic sound waves, which vibrate the tympanic membrane through the external auditory canal 7. Hence, an intelligible sound can be heard without interruption by ambient noises.

However, the above described transmitting device and the receiving device are two different devices. It will be more convenient if the devices are assembled into one.

SUMMARY OF THE INVENTION

An object of the present invention is to provide a transceiver provided with a solid-borne transmitting device and a solid-borne receiving device, where the transceiver may be used in various circumstances.

According to the present invention there is provided a transceiver having a case and a press-to-talk switch provided on the case, comprising first air-borne converting means having a loudspeaker for converting an electric signal into an air-borne sound and a microphone for converting air-borne sound into an electric signal second, solid-borne converting means having a loudspeaker for converting an electric signal into solid-borne sound and a microphone for converting solid-borne sound into an electric signal, each having a vibrating member projecting from the case of the transceiver, and a switch for selecting one of the first and second converting means.

In accordance with the present invention, when the switch is operated to select the solid-borne converting means, the projecting member of the solid-borne loudspeaker is pressed against a resin foam earplug inserted in an ear and the projecting vibrating member of the solid-borne microphone is pressed against a cheek. Solid-borne sound picked up by the microphone to be transmitted is free of ambient noise and the solid-borne sound from the loudspeaker can be clearly heard without interference by ambient noises.

These other objects and features of these invention will become understood from the following description with reference to the accompanying drawings.

DETAILED DESCRIPTION OF THE PREFERRED EMBODIMENTS

Figure 1:
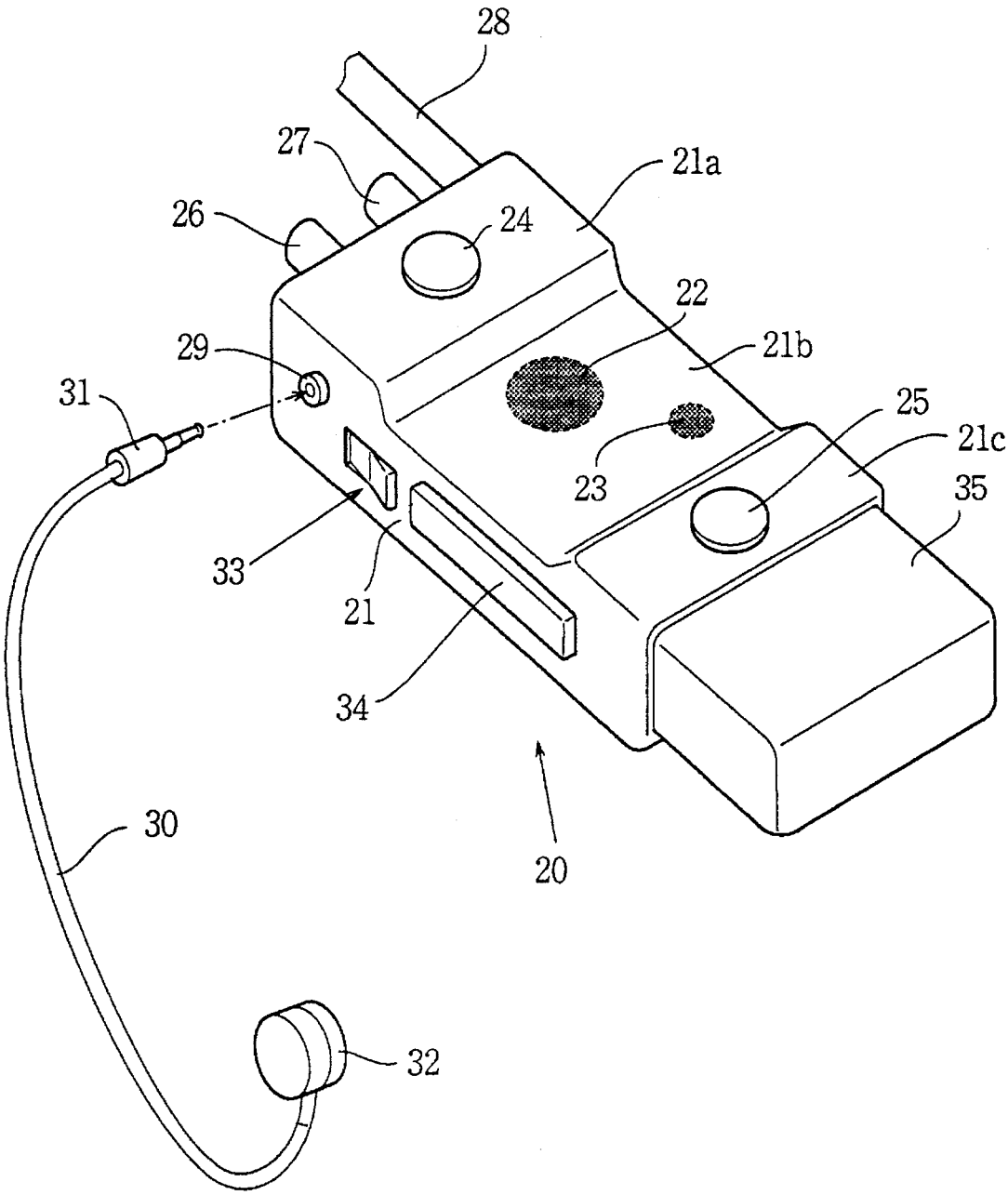
FIG. 1 is a perspective view of a transceiver according to the present invention.

Referring to FIG. 1, a transceiver 20 according to the present invention has a rectangular casing 21 comprising an upper raised portion 21*a*, central recessed portion 21*b*, and a lower raised portion 21*c*. A battery 35 is detachably attached to the casing 21 at the bottom of the lower raised portion 21*c*.

Figure 3:
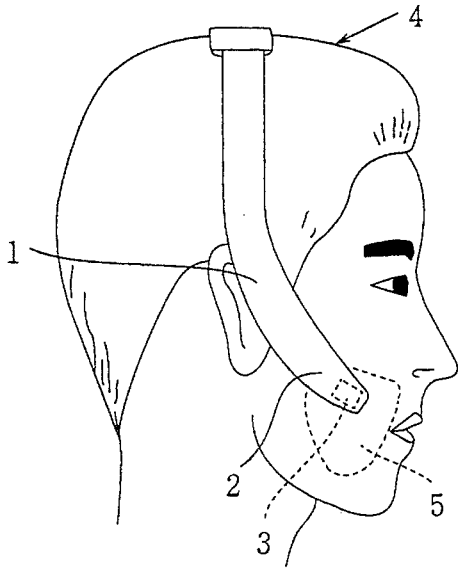
FIG.3 PRIOR ART
FIG. 3 is a schematic illustration showing a conventional solid-borne headset transmitter worn over a head.
Figure 4:
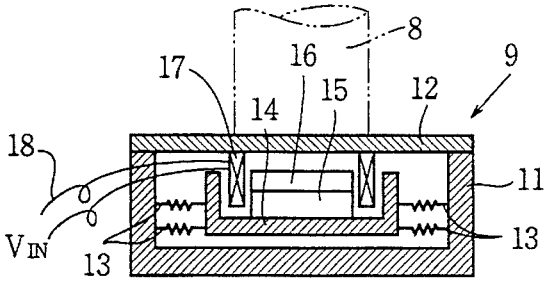
FIG.4 PRIOR ART
FIG. 4 is a sectional view of an exciter provided in a conventional solid-borne earphone.
Figure 5:
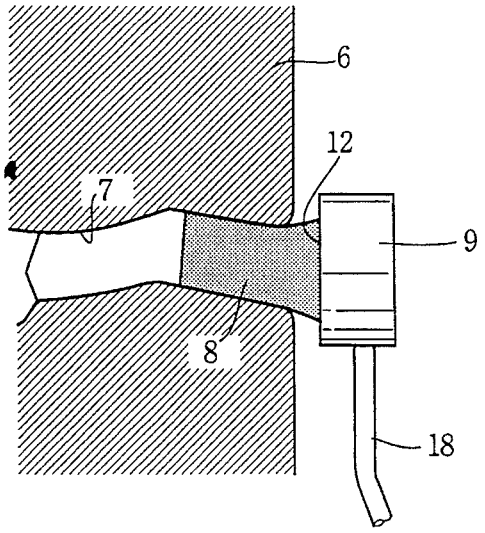
FIG.5 PRIOR ART
FIG. 5 is a schematic illustration showing the conventional earphone when put to an ear.

In the central recessed portion 21*b* are provided an ordinary loudspeaker 22 as an air-borne transmitting device and an air-borne microphone 23. On the upper raised portion 21*a* is disposed a solid-borne loudspeaker 24 and on the lower raised portion is a solid-borne microphone 25. The solid-borne loudspeaker 24 and microphone 25 are similar to the exciter 9 shown in FIG. 4 and to the pickup 3 of FIG. 3. A diaphragm of each of the devices 24 and 25 projects from the casing 21 to transmit elastic waves. The distance between the loudspeaker 24 and the microphone 25 is so determined that when the loudspeaker 24 is applied to the ear of an operator, the microphone 25 is in contact with his cheek.

On the upper end of the casing 21 are mounted knobs of a volume controller 26 and a channel selector 27. The knobs are adapted to be rotated to set the volume, and the resonant frequency for tuning in the transmitted radio waves. An antenna 28 is further mounted on the top of the transceiver 20.

On the side of the casing adjacent the top thereof, an earphone jack 29 is provided for connecting an earphone device having a solid-borne earphone 32 and a plug 31 connected to the earphone through a cable 30. The transceiver has an automatic changeover switch (not shown), which, upon insertion of the plug 31 into the jack 29, renders the audio signal applied to the transceiver 20 to be fed to the earphone 32 instead of to one of the loudspeakers 22 and 24. Thus, the operator can easily hear the transmission through the earphone 32.

Further provided on the side of the casing 21 are a changeover see-saw switch 33 and a press-to-talk switch 34. The changeover switch 33 is operated when changing the operational mode of the transceiver from the air-borne transmission mode to the solid-borne transmission mode and vice versa. The press-to-talk switch 34 is depressed while the operator is talking on the transceiver.

Figure 2:
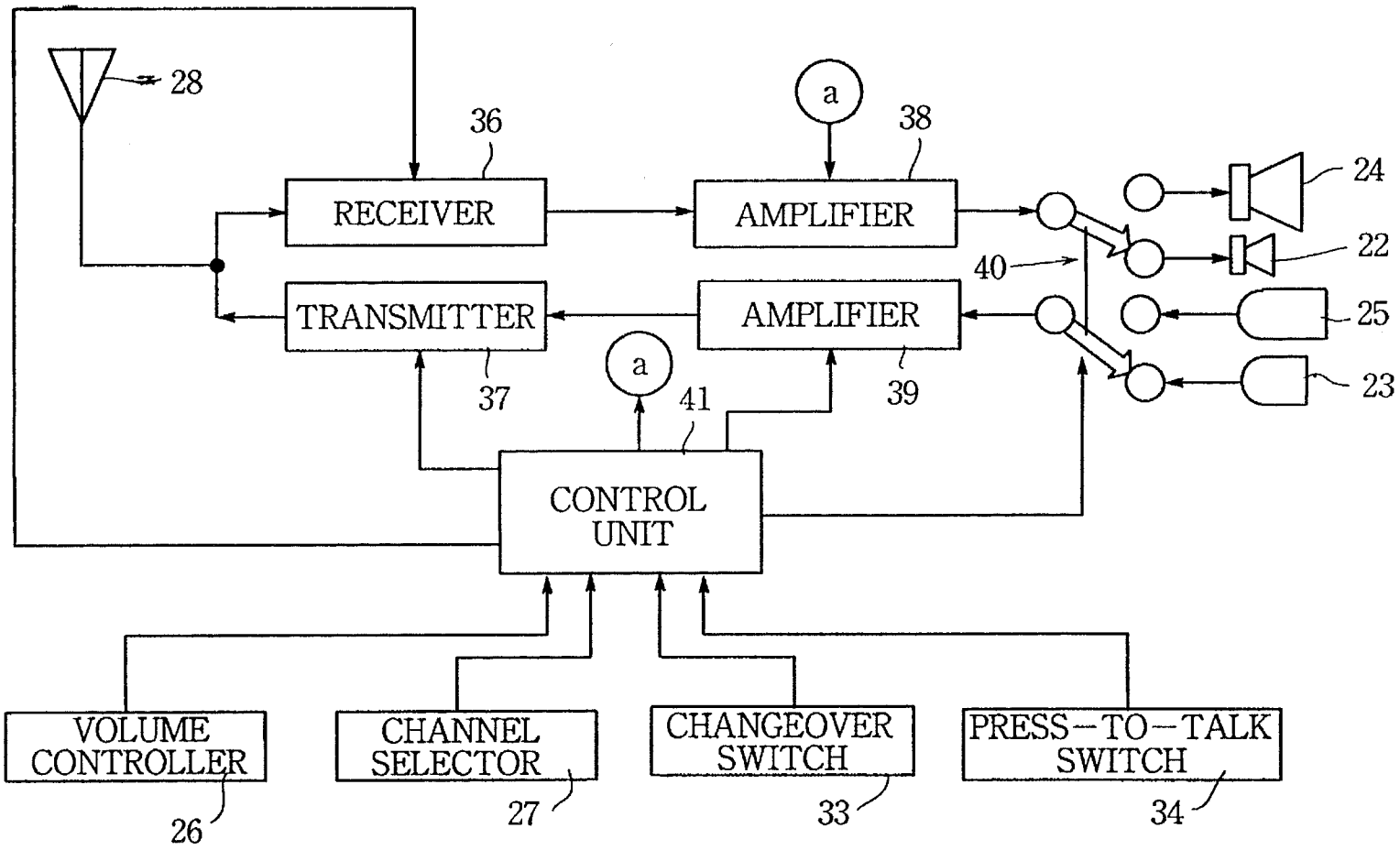
FIG. 2 is a block diagram showing a control system provided in the transceiver of FIG. 1.

Referring to FIG. 2, the control system of the transceiver 20 has a control unit 41 to which output signals of the volume controller 26, channel selector 27, changeover see-saw switch 33 and the press-to-talk switch 34 are applied. The control unit 41, in response to these signals, applies control signals to various parts of the control system, such as a receiver 36 for demodulating transmitted radio waves into audio signals, amplifier 38 for amplifying the audio signals, an amplifier 39 for amplifying audio signals picked up by microphones 23 and 25, and a transmitter 37 for modulating the audio signal from the amplifier 39 into a carrier frequency which is transmitted through the antenna 28. Namely, the resonant frequency of the receiver 36 is set in accordance with the operation of the channel selector 27. The receiver 36 is rendered inoperative by the control unit 41 when the press-to-talk switch 34 is depressed. The control unit 41 further controls, in accordance with the operation of the changeover switch 33, a linked switch 40 which selectively connects the amplifiers 38 and 39 with the air-borne loudspeaker 22 and the air-borne microphone 23, respectively, or the solid-borne loudspeaker 24 and the solid-borne microphone 25, respectively.

The operation of the transceiver 20 is described hereinafter. When the transceiver 20 is used under normal surroundings where the noise therein is moderate, the air-borne transmission mode is selected. The changeover switch 33 is operated to connect the linked switch 40 with the air-borne loudspeaker 22 and with the air-borne microphone 23, as shown in FIG. 2. As a result, the voice of a caller is heard through the air-borne loudspeaker 22. For transmission, the operator depresses the press-to-talk switch 34 and speaks into the air-borne microphone 23, thereby to transmit the voice through the transmitter 37.

In a loud background, such as at a construction site and motor race course, where noise level exceeds 90 dB, the solid-borne transmission mode is selected. Namely, the changeover switch 33 is operated so that the linked switch 40 connects the amplifier 38 with the solid-borne loudspeaker 24 and the amplifier 39 with the solid-borne microphone 25.

The operator wears an earplug made of resin foam in each of his ears. The earplug may be soft elastonomer shaped into a cone. The earplug of either type is preferably without any perforations in order that the transmission of an air-borne sound may be prevented.

In order to hear the transmission, the operator holds the transceiver 20 close to one of his ears and presses the diaphragm of the solid-borne speaker 24 to the earplug. As already described with regard to the conventional solid-borne receiving device, the elastic waves from the loudspeaker 24 are transmitted to the tympanic membrane through the earplug and external auditory canal. Since the other ear is insulated from sound by the earplug, the ambient noise is shut out. Thus the operator can clearly hear the transmission.

It is easier to use the earphone device when it is necessary to constantly listen to the transmission. The plug 31 of the earphone device is plugged into the earphone jack 29, so that the amplifier 38 is connected with the earphone through the plug 31 and the cable 30. Hence, by holding the earphone 32 to the earplug, the solid-borne sound can be heard.

For making a transmission, the operator holds the transceiver 20 so that the diaphragm of the solid-borne microphone 25 is pressed to the cheek, and depresses the press-to-talk switch 34. When the operator speaks, causing the cheek to vibrate, the solid-borne microphone 25 converts the vibration into an electric signal. The electric signal is amplified by the amplifier 39 and modulated into the carrier frequency by the transmitter 37 so as to be transmitted through the antenna 28. Since the ambient noise is not included in the transmitted sound, a good speech intelligibility is provided.

The present invention may be modified to provide an earphone device having a plurality of earphones connected to the plug 31. With two earphones, the operator can listen with both of his ears. With three or more earphones, several people can listen at the same time.

The changeover switch 33 need not be confined to a see-saw switch, but may be a switch having two depressible buttons, or alternatively, a simple on/off switch.

From the foregoing it will be understood that the present invention provides a transceiver having air-borne sound transmitting and receiving devices and solid-borne sound transmitting and receiving devices. Under extremely noisy circumstances, the solid-borne transmitting and receiving devices are selected so that the solid-borne sound is transmitted and heard without any disturbances by the ambient noises. Thus, the usability of the transceiver is improved.

While the presently preferred embodiments of the present invention have been shown and described, it is to be understood that these disclosures are for the purpose of illustration and that various changes and modifications may be made without departing from the scope of the invention as set forth in the appended claims.

What is claimed is:

1. A transceiver communication device comprising:

a case containing a transmitter means and a receiver means;

a first converting means mounted in a front surface of said case including air-borne converting means having a first loudspeaker for converting an electrical signal into an audible air-borne sound and a first microphone for converting air-borne sound into an electrical signal;

a second converting means in said case including solid-borne converting means having a second loudspeaker for converting an electrical signal into solid-borne sound and a second microphone for converting solid-borne sound into an electrical signal, said solid borne converting means having a vibrating member projecting from said front surface of the case of the transceiver; a distance between the second loudspeaker and the second microphone being determined such that when the second loudspeaker is applied to an ear of an operator, the second microphone is in contact with the operator's cheek; and a switch mounted in said case for selectively connecting one of the first and second converting means to the transmitter means and receiver means to cause the transceiver to operate in either one of an air-borne mode and a solid-borne mode.

2. A transceiver communication device comprising:

a case containing a transmitter means and a receiver means;

a first converting means mounted in a front surface of said case including air-borne converting means having a first loudspeaker for converting an electrical signal into an audible air-borne sound and a first microphone for converting air-borne sound into an electrical signal;

a second converting means in said case including solid-borne converting means having a second loudspeaker for converting an electrical signal into solid-borne sound and a second microphone for converting solid-borne sound into an electrical signal, said solid borne converting means having a vibrating member projecting from a front surface of the case of the transceiver; and a switch mounted in said case for selectively connecting one of the first and second converting means to the transmitter means and receiver means to cause the transceiver to operate in either one of an air-borne mode and a solid-borne mode;

wherein the case has an upper raised portion, a central recessed portion, and a lower raised portion, and the loudspeaker and the microphone of the air-borne converting means are provided in the central recessed portion, the second loudspeaker is provided in the upper raised portion, and the second microphone is provided in the lower raised portion.

* * * * *